United States Patent [19]

Clay

[11] 4,420,857

[45] Dec. 20, 1983

[54] BAG FASTENER

[75] Inventor: Bobby L. Clay, Rohnert Park, Calif.

[73] Assignee: Cevco, Inc., Rohnert Park, Calif.

[21] Appl. No.: 289,207

[22] Filed: Aug. 3, 1981

Related U.S. Application Data

[63] Continuation of Ser. No. 118,477, Feb. 2, 1980, abandoned.

[51] Int. Cl.[3] ..... B65D 63/00; B65D 30/00

[52] U.S. Cl. ..... 24/16 PB; 24/30.5 R; 24/30.5 P; 292/319; 383/71; 383/92

[58] Field of Search ..... 24/16 PB, 17 B, 17 AP, 24/30.5 L, 30.5 R, 201 TR, 265 AL, 265 EE, 208 A, 30.5 W, 302, 30.5 P; 150/3, 11, 20, 15, 25, 43, 13; 292/319–321

[56] References Cited

U.S. PATENT DOCUMENTS

| | | | |
|---|---|---|---|
| 1,588,695 | 6/1926 | Boehm | 150/3 |
| 1,982,813 | 12/1934 | Jacobi | 150/3 |
| 3,402,435 | 9/1968 | Merser | 24/16 PB |
| 3,516,124 | 6/1970 | Merser | 24/16 PB |
| 3,595,506 | 7/1971 | Saunders | 24/16 PB |
| 3,718,355 | 2/1973 | Canter | 292/321 |
| 3,733,655 | 5/1973 | Kolibar | 24/208 A |
| 3,816,879 | 6/1974 | Merser et al. | 24/16 PB |
| 3,983,603 | 10/1976 | Joyce | 24/16 PB |
| 4,240,183 | 12/1980 | Samimoto | 24/16 PB |

FOREIGN PATENT DOCUMENTS

| | | | |
|---|---|---|---|
| 1075876 | 5/1954 | France | 24/30.5 P |
| 1110010 | 2/1956 | France | 24/16 PB |
| 1418989 | 11/1966 | France | 24/30.5 P |
| 323404 | 12/1934 | Italy | 150/13 |

*Primary Examiner*—Gene Mancene
*Assistant Examiner*—John Weiss
*Attorney, Agent, or Firm*—Majestic, Gallagher, Parsons & Siebert

[57] ABSTRACT

A fastener is provided which is useful with a flexible article having a plurality of orifices, such as a conventional laundry bag. The fastener is adapted to be held in one of the orifices and thus carried with the bag for immediate availability. The fastener comprises an elongated body with one and an other spaced apart ends. A medial portion interconnects a flexible strap and a shank of the body. A bore is at the one end into which a leading tip at the other end is adapted to be releasably associated.

7 Claims, 7 Drawing Figures

BAG FASTENER

This is a continuation of Ser. No. 118,477, filed Feb. 2, 1980, now abandoned.

DESCRIPTION

1. Field of the Invention

This invention relates to a fastener useful with a flexible article having a plurality of orifices therethrough, and more particularly relates to a fastener for releasably closing a laundry bag or the like.

2. Background Of The Invention

A variety of flexible articles having a plurality of orifices therethrough, the orifices often reinforced with grommets, are known and useful items. Such items include laundry bags, tarpaulins and the like. Laundry bags, for example, are conventional items used by commercial laundries to collect garments for cleaning. The laundry bags are then closed during transportation to the cleaning facility. Closure of conventional laundry bags is usually by means such as a draw-string carried in a casing extending about an open end of the laundry bag or by means such as a large safety pin inserted through a plurality of the reinforced orifices adjacent the bag's open end. The use of draw-strings for closing laundry bags is awkward and time consuming, since the draw-string ends must be tied and then untied at the cleaning facility. Often draw-strings are difficult to untie and are cut in order to open the bags. Further, the draw-string often pulls out of its casing. The use of fastening means such as safety pins creates problems since the pins are usually separate from the laundry bags, and are not associated therewith until closure. Thus, the pins may not be readily available when needed. Also, conventional pins usually have a sharp point which can snag garments within the laundry bag.

U.S. Pat. No. 3,943,998 discloses a laundry bag wherein a hook and pile flap fastens to another flap in order to close the laundry bag. However, the laundry bag disclosed by U.S. Pat. No. 3,943,998 is of special construction in order to effect the closing thereof, and thus is not adaptable to the various conventional and popular laundry bags, tarpaulins and the like.

SUMMARY OF THE INVENTION

The present invention is directed to overcoming one or more of the problems as set forth above.

In one aspect of this invention, a fastener comprises an elongated body with a one and an other spaced apart ends and has means for releasably connecting the ends together. The elongated body includes a strap which longitudinally extends a predetermined first distance from the other end of the body toward the one end of the body. The elongated body further includes a shank which longitudinally extends a predetermined second distance from the one end of the body toward the other end of the body. The strap is flexible whereas the shank is relatively rigid. A medial portion of the body interconnects the shank and the strap and is adapted to hold the body in an orifice of a flexible article.

The above fastener may be quickly and easily associated with, and carried by, a flexible article having a plurality of orifices such as a conventional laundry bag. The fastener may be used to rapidly gather the flexible article into a variety of desired configurations, particularly may be used to position the flexible article into and out of a closed position.

BRIEF DESCRIPTION OF THE DRAWINGS

Other objects of this invention will become apparent from the following description and accompanying drawings wherein.

DETAILED DESCRIPTION OF THE PREFERRED EMBODIMENTS

Figure 3:
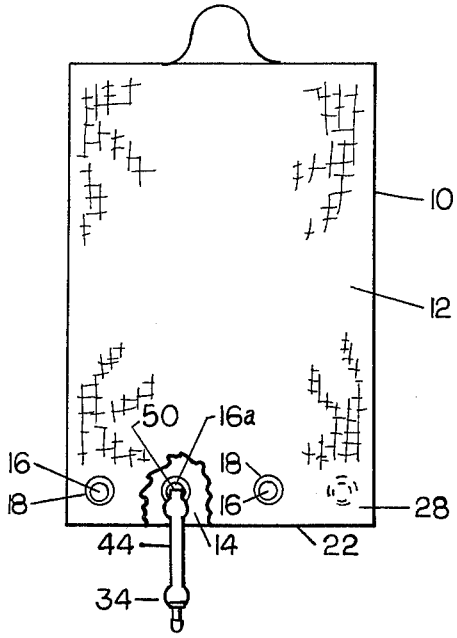
FIG. 3 is a back view, with a portion broken away, similar to FIG. 1.

Referring to FIG. 3, an article 10 has an outside surface 12, an inside surface 14 and a plurality of orifices 16 passing between surfaces 12,14. Orifices 16 are normally circular in shape and are reinforced by any of various conventional means, such as grommets 18. In the best mode contemplated for use in the invention, article 10 is a laundry bag, as is herein illustrated, and has an open end 22 from which orifices 16 are spaced and along which orifices 16 are circumferentially disposed.

Figure 4:
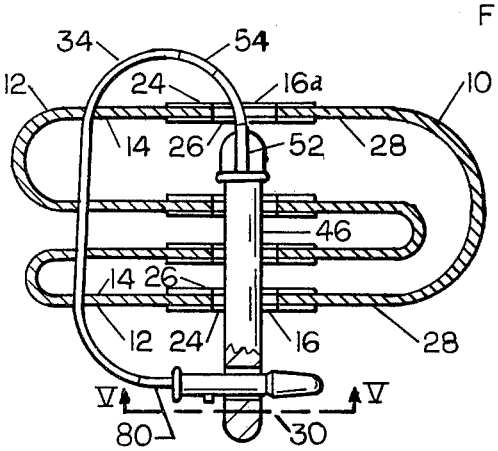
FIG. 4 is a diagrammatic view partially in cross-section which illustrates operation of the fastener embodiment to close a flexible article, such as the bag illustrated by FIG. 1.

Referring to FIG. 4, orifieces 16 define opposed side 24,26, each of which is adjacent a respective one of the surfaces 12,14. Orifices 16 are normally substantially equivalent in diameter. At least a portion 28 of laundry bag 10 which surrounds orifices 16, and which is normally contiguous with open end 22, is a flexible material such as woven or knit fabric, plastic sheeting and the like.

A fastener in accordance with the present invention, hereinafter referred to generally as fastener embodiment 30, is useful to gather flexible portion 28 of laundry bag 10, and is more particularly useful to releasably close open end 22.

Figure 6:
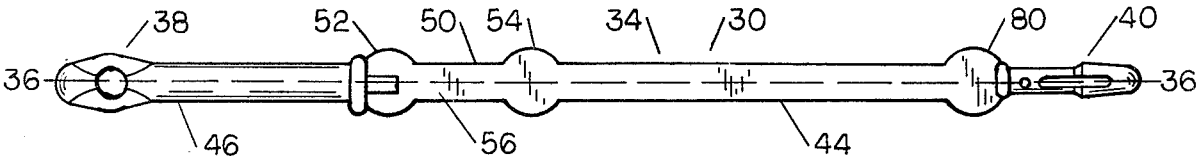
FIG. 6 is a side elevational view of the fastener embodiment.
Figure 7:
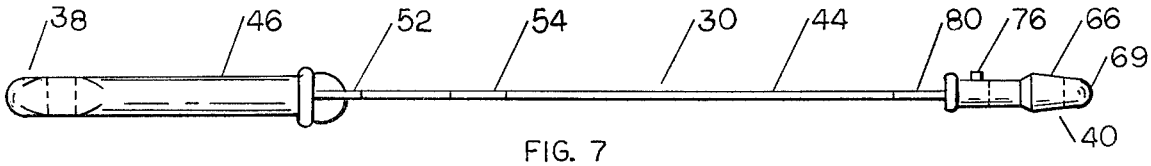
FIG. 7 is a top view of the fastener embodiment.

Referring to FIG. 6, fastener embodiment 30 comprises a body 34 extending along a longitudinal axis 36 between one end 38 and an other end 40. Body 34 is preferably formed as a unitary, molded piece of resiliently deformable material such as polypropylene, polyethylene, nylon or the like. The reason for the resiliently deformable properties for body 34 shall be further discussed hereinafter.

Body 34 has a flexible strap 44 which extends a predetermined first distance, or length, from other end 40 generally toward one end 38. The flexibility of strap 44 is partially accomplished by forming strap 44 as a relatively thin, elongated member, and partially accomplished by the resiliently deformable material of which body 34 is formed. A shank 46 extends a predetermined second distance, or length, from one end 38 toward other end 40. Shank 46 is substantially circular in cross-section, preferably is formed as a cylinder, and is rigid relative strap 44.

Body 34 has a medial portion 50 which interconnects the strap 44 and shank 46.

Figure 1:
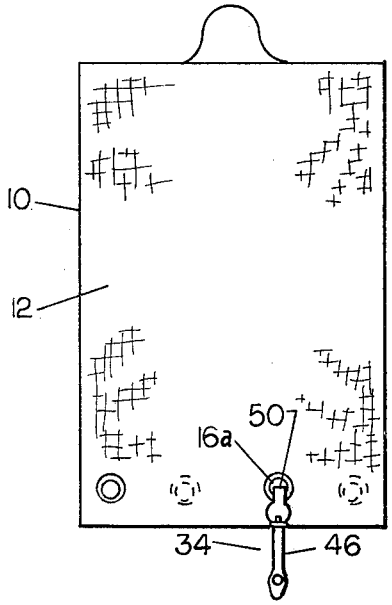
FIG. 1 is a front view of a laundry bag having a fastener embodiment of the present invention therewith.

Referring to FIGS. 1 and 3, medial portion 50 is adapted for holding body 34 in one orifice **16*a* of article 10. So held, strap 44 outwardly protrudes the predetermined first distance from either outside surface 12 or inside surface 14 (herein illustrated as protruding from inside surface 14). Shank 46 is held to outwardly protrude the predetermined second distance from either outside surface 24 or inside surface 1' (herein illustrated as protruding from outside surface 12**).

Figure 2:
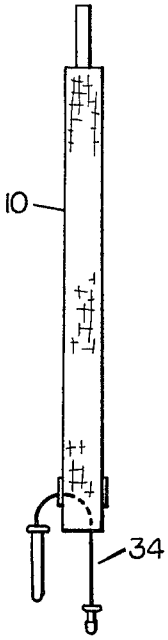
FIG. 2 is a side view similar to FIG. 1.

Returning to FIG. 6, medial portion 50 includes a pair of closely adjacent, protruding members 52,54 which project laterally from longitudinal axis 36 of body 34. It is preferred that protruding members 52,54 laterally project by substantially an equivalent distance. A neck member 56 is disposed between protruding members 52,54 and is narrowed relative thereto. The distance by which the protruding members 52,54 laterally project is slightly greater than the diameter of orifices 16. This is so that one protruding member 52 or 54 may be manually forced by temporary deformation through one orifice (illustrated by FIGS. 1-4 as orifice 16*a*) until neck member 56 rides in the one orifice 16*a*. Referring to FIG. 4, it may be seen that the protruding members 52,54 are thus positioned adjacent the sides 26,24 respectively and hold body 34 in association with article 10. FIGS. 1-3 illustrate body 34 held, or retained, in the one orifice 16*a* of article 10. Thus held, fastener embodiment 30 is immediately available to close the open end 22 of article 10 whenever desired.

Figure 5:
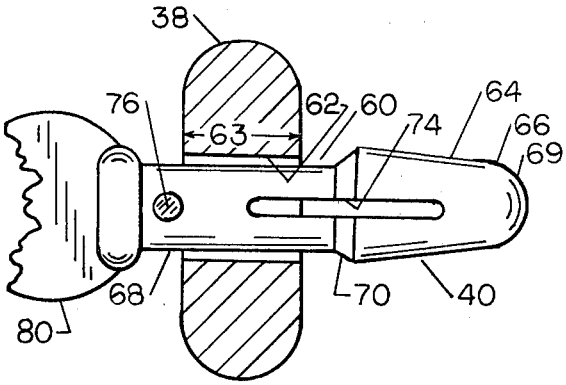
FIG. 5 is an enlarged detail taken along lines V—V of FIG. 4.

Referring to FIG. 5, fastener embodiment 30 further comprises means 60 for releasably connecting ends 38,40 together. Means 60 includes a bore 62 passing through shank 46 adjacent one end 38, and a peniform member 64 at other end 40. Bore 62 defines a depth 63.

Peniform member 64 has a leading tip 66, a cylindrical shaft 68 and an annular surface 70 disposed between and contiguous with leading tip 66 and shaft 68. Leading tip has a relatively blunt, or hemispherical, terminal portion 69. Annular surface 70 projects radially outwardly form cylindrical shaft 68 to leading tip 66 and is inclined therebetween toward leading tip 66. An elongated slot 74 passes through peniform members 64 and is cnetered on an annular surface 70 so as to extend partially into leading tip 66 and partially into shaft 68. Peniform member 64 further preferably includes a stop member 76 on shaft 68 which transversely extends therefrom. Stop member 76 is longitudinally positioned from annular surface 70 a distance equivalent to or slightly greater than depth 63 of bore 62.

Since peniform member 64 is composed of resiliently deformable material, then as leading tip 66 is manually urged into bore 62, and as aided by slot 74, leading tip 66 will deform laterally as it passes through bore 62. Once passed therethrough, leading tip 66 resiliently expands laterally outwardly and thus returns to its original size. As illustrated by FIG. 5, end 38,40 are thus connected together with shaft 68 riding in bore 62. Stop member 76 and annular surface 70 assist in retaining shaft 68 in bore 62. The just-described connection of ends 38,40 is easily releasable upon the application of a manual, longitudinally directed force being imposed against the blunt leading tip 66. The ease of release is facilitated by the inclination of annular surface 70 toward leading tip 66.

Turning to FIG. 4, there is illustrated fastener 30 as having been used to gather flexible portion 28 so that surface 12,14 are folded together. The preferred cylindrical shape and the relative rigidity of shank 46 permits easy and rapid manipulation, or threading, of shank 46 through the remaining orifices 16. Thus, when article 10 is a laundry bag or the like, the open end 22 may be gathered into a closed position, and flexible strap 44 is looped so that ends 38,40 may be releasably connected, or snapped, together by means 60. The predetermined second distance, or length, of shank 46 is preferably chosen to be at least as large as a sum of a distance between each of sides 24,26. This is so that shank 46 may be threaded through all of the remaining orifiecs 16, as illustrated by FIG. 4. A protruding member 80, normally substantially equivalent to either protruding member 52 or 54, is preferably adjacent peniform member 64 and outwardly protrudes from strap 44. Protruding member 80 tends to encourage a person utilizing fastener 30 to thread shank 46 through all of the remaining orifices 16 (rather than strap 44). The predetermined first distance, or length, of strap 44 is preferably larger than the second distance. This is so that strap 44 may be looped about shank 46, and so that portion 28 is closely bunched on shank 46 when threaded through all orifices 16.

Other aspects, objects and advantages of this invention can be obtained from a study of the drawings, the disclosure and the appended claims.

I claim:

1. A fastener capable of being assembled, with a flexible article having a plurality of annular orifices, the orifices being of a predetermined diameter, comprising:

an elongated body defining a longitudinal axis with a one and an other spaced apart ends and being formed of a resiliently deformable material;

a flexible strap of said body longitudinally extending a predetermined first distance from said other end toward said one end;

a shank of said body longitudinally extending a predetermined second distance from said one end toward said other end, said shank being rigid relative said strap;

a medial portion of said body interconnecting said shank and said strap and of a construction sufficient to be fitted and held in one of the orifices of the flexible article; and reusable means for snappingly connecting said ends of said body together and for easily releasing a connection of said ends, said reusable means including a bore passing through said shank adjacent said one end of said body and a peniform member at said other end of said body, said peniform member having a blunt leading tip, a cylindrical shaft, and an annular surface between and continguous with said leading tip and said shaft, said annular surface radially outwardly projecting from said shaft to said leading tip and inclined therebetween toward said leading tip, said ends of said body being easily released by application of a manual force imposed upon said blunt leading tip of said peniform member.

2. The fastener in claim 1 wherein: the manual force imposed upon said blunt leading tip for release of said ends is directed along said longitudinal axis of said body.

3. The fastener as in claim 1 wherein:

said medial portion includes a pair of closely adjacent, laterally protruding members and a neck member therebetween narrowed relative said protruding members.

4. In a laundry bag having a plurality of substantially equivalently sized orifices therethrough, an improvement comprising:

an elongated body with a one and an other spaced apart ends;

a flexible strap of said body longitudinally extending a predetermined first distance from said other end toward said one end;

a shank of said body longitudinally extending a predetermined first distance from said other end toward said one end;

a medial portion of said body interconnecting said shank and said strap and disposed within one of said orifices with said strap outwardly extending from a one side of said orifice with said strap outwardly extending from a one side of said orifice substantially the first distance and said shank outwardly extending from an other side of said one orifice substantially the second distance; and, reusable means for easily and repeatedly connecting and disconnecting said ends of said body together by application of a manual force imposed upon said other end of said body.

5. The improvement as set forth by claim 4 wherein:

said medial portion includes a pair of closely adjacent, transversely protruding members and a neck member therebetween, said neck member being narrowed relative said protruding members.

6. The improvement as set forth by claim 5 wherein:

said reusable means for easily and repeatedly connecting and disconnecting said ends together includes a bore passing through said shank adjacent said one end of said body and a peniform member at said other end of said body, said peniform member having a leading tip, a cylindrical shaft, and an annular surface between and contiguous with said leading tip and said shaft, said annular surface radially outwardly projecting from said shaft to said leading tip and inclined therebetween toward said leading tip.

7. The improvement as set forth by claim 4 wherein:

the predetermined second distance of said shank is at least as large as a sum of a distance between each of said opposed sides of said orifices, and the predetermined first distance of said strap is larger than the predetermined second distance of said shank.

* * * * *

UNITED STATES PATENT AND TRADEMARK OFFICE

CERTIFICATE OF CORRECTION

PATENT NO. : 4,420,857

DATED : Dec. 20, 1983

INVENTOR(S) : Clay

It is certified that error appears in the above-identified patent and that said Letters Patent is hereby corrected as shown below:

Col. 6, line 5: "claim 5" should read --claim 4--.

Signed and Sealed this

*Seventeenth* Day of *April 1984*

[SEAL]

*Attest:*

GERALD J. MOSSINGHOFF

*Attesting Officer*

*Commissioner of Patents and Trademarks*